United States Patent [19]

Kircher et al.

[11] 4,105,161

[45] Aug. 8, 1978

[54] METHOD AND MACHINE FOR MAKING ARTIFICIAL SNOW

[75] Inventors: Everett F. Kircher, Boyne Falls; James L. Dilworth, Petoskey, both of Mich.

[73] Assignee: Boyne Mountain Lodge, Inc., Boyne Falls, Mich.

[21] Appl. No.: 742,785

[22] Filed: Nov. 18, 1976

[51] Int. Cl.[2] ..... F25C 3/04

[52] U.S. Cl. ..... 239/2 S; 62/74; 239/14

[58] Field of Search ..... 239/2 S, 14, 428, 433, 239/521, 523; 62/74

[56] References Cited

U.S. PATENT DOCUMENTS

| | | | |
|---|---|---|---|
| 2,968,164 | 1/1961 | Hanson | 239/2 S |
| 3,964,682 | 6/1976 | Tropeano et al. | 239/14 X |
| 3,979,061 | 9/1976 | Kircher | 239/14 X |

*Primary Examiner*—Joseph F. Peters, Jr.
*Assistant Examiner*—Michael Mar
*Attorney, Agent, or Firm*—Barnes, Kisselle, Raisch & Choate

[57] ABSTRACT

In a method and machine for making artificial snow of the type which includes a blower for providing a substantially unidirectional high-volume air stream and a plurality of nozzles for directing water spray into the air stream, the improvement wherein the water nozzles are grouped in an arcuate array entirely above the centerline of the air stream, and wherein a deflector is disposed in the air stream to direct a lower portion of the air stream upwardly toward the nozzles. A seeder nozzle is disposed in the "shadow" of the deflector and directs a water/air mixture upwardly at an angle into the air stream to form seed crystals.

10 Claims, 7 Drawing Figures

METHOD AND MACHINE FOR MAKING ARTIFICIAL SNOW

The present invention relates to a method and apparatus for making artificial snow.

In typical prior art methods or machines for making artificial snow, epitomized by the apparatus disclosed in the U.S. Kircher Pat. No. 3,979,061, one or more nozzles are disposed to spray water or a water/compressed-air mixture into a high-volume air movement or stream being propelled substantially at atmosphere pressure such that the water spray droplets crystalize and fall to the ground as artificial snow. A problem common to most, if not all, of such prior art devices is a tendency of some water droplets injected into the air stream to fall out of the air stream between the apparatus and the deposit area prior to complete crystalization. This short fall tendency has been termed "dribbling." An accumulation of such partially crystalized water, which freezes after hitting the ground, may result in formation of undesirable and potentially dangerous ice patches and otherwise produce deterioration of the existing artificial and/or natural snow ground cover.

It has been recognized as a general principle that the quantity of snow produced is a function of the amount of water used. However, under ambient air conditions of given temperature and humidity and for a particular rate of high-volume air movement, only a limited amount of water may be sprayed onto the air movement and result in high-quality, dry snow. Excess water may cause either the above-discussed "dribble effect" or a deposite of wet snow, or both. Thus, there is a trade-off between snow quantity and quality for a given apparatus which varies in accordance with climatic conditions. In the above-mentioned Kircher patent, means for optimizing this quantity/quality trade-off was provided in the form of one or more individually selectable water spray nozzles at the periphery of the air movement each associated with a compressed air nozzle provided outwardly of the water nozzle such that compressed air helped to disperse spray from the corresponding water nozzle into the air stream, and to thus enhance both snow quality and quantity. However, under certain climatic conditions the prior art Kircher apparatus was found to reduce, but not eliminate, the undesirable dribble effect.

Accordingly, general objects of the present invention are to provide a method and machine for making artificial snow which enhances the above-mentioned snow quality-quantity trade-off over a wide range of climatic conditions and/or which reduces or eliminates the above-referenced dribble effect.

Additional objects as well as advantages and features of the invention will be best understood from the following description when read in conjunction with the accompanying drawings in which.

Figures 1, 4:
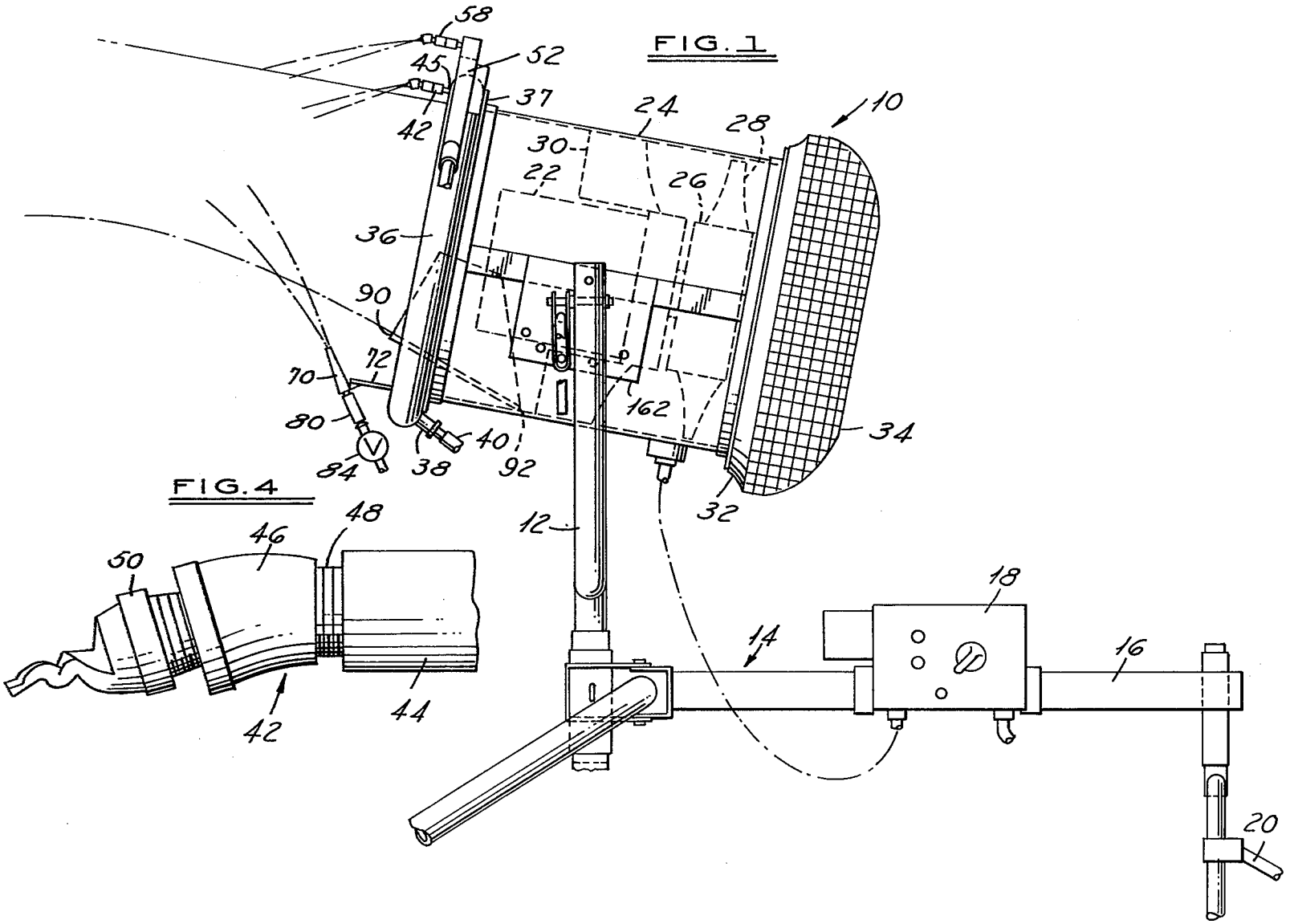
FIG. 1 is a partial side elevational view of an exemplary but presently preferred embodiment of the invention.
Figure 2:
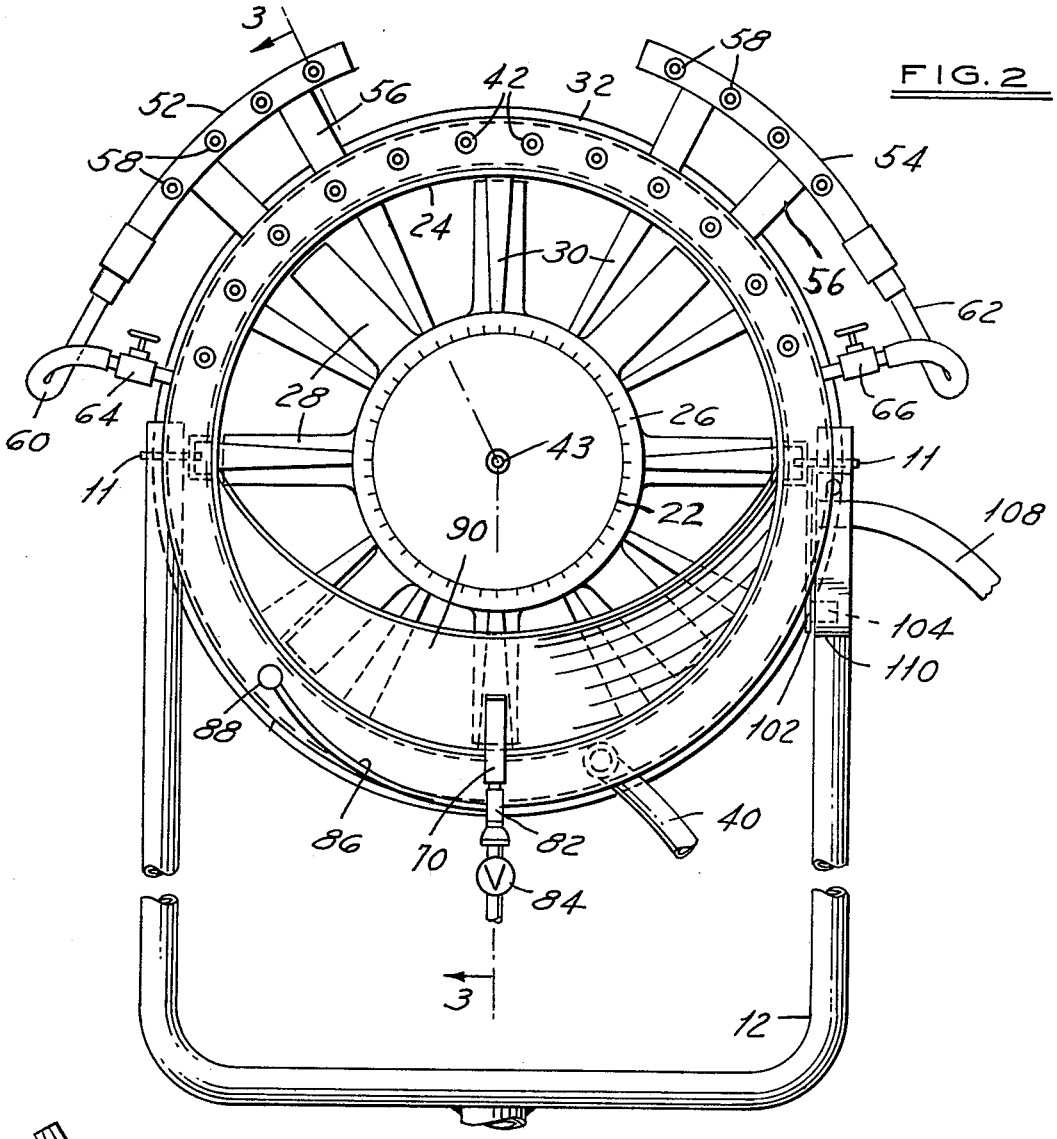
FIG. 2 is a front elevational view of the apparatus depicted in FIG. 1.
Figure 5:
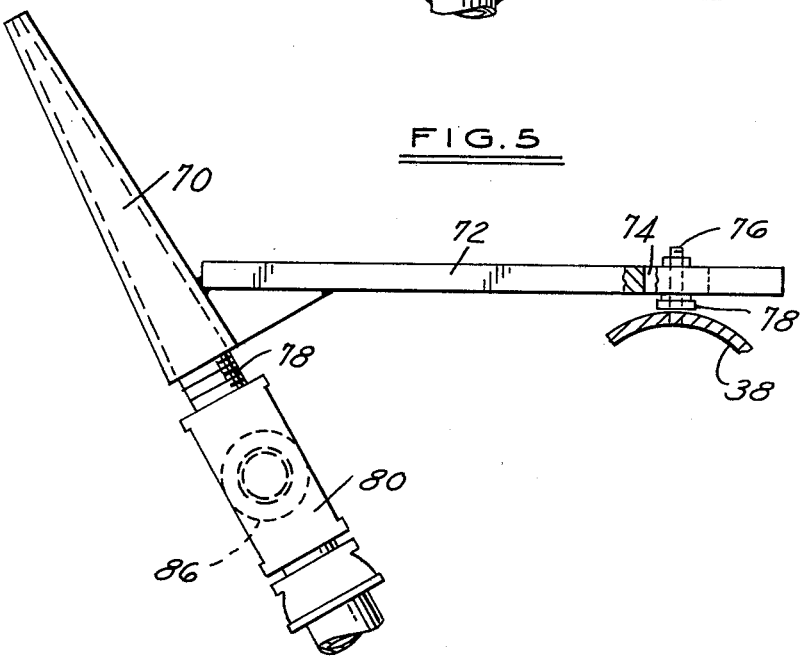
Figure 3:
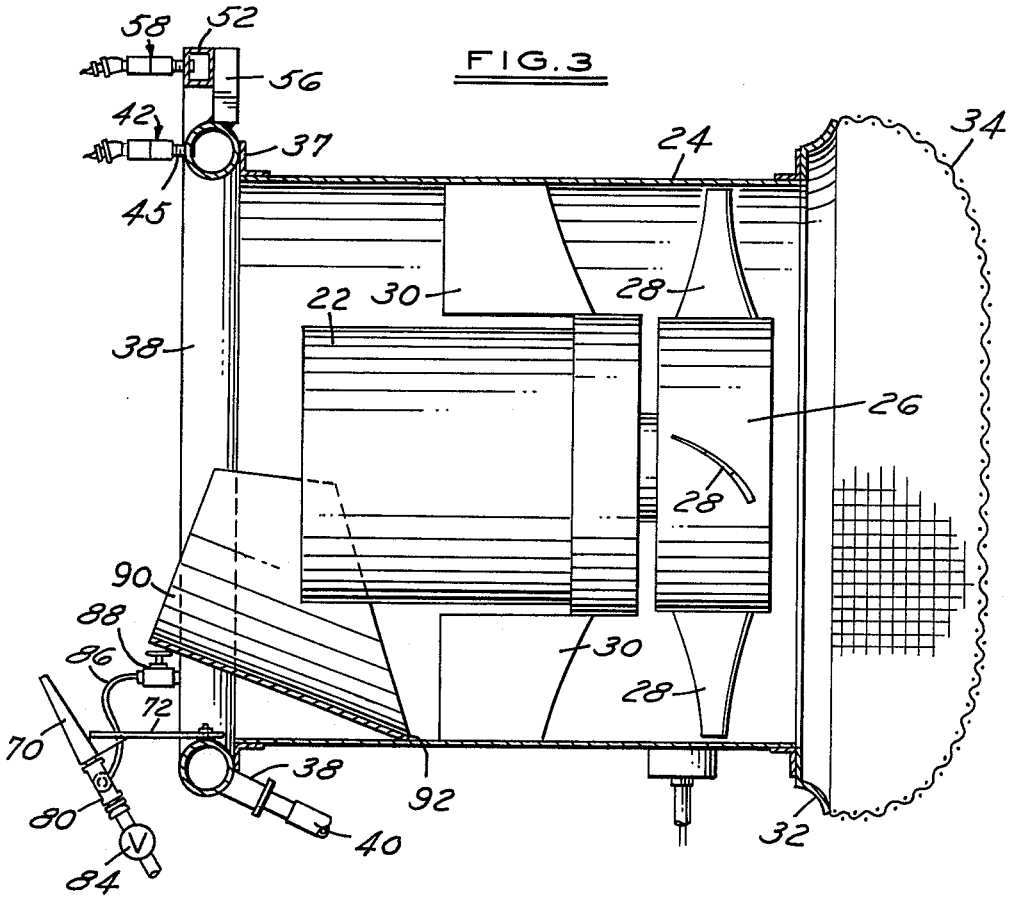
FIG. 3 is a side sectional view of the apparatus taken along the line 3—3 in FIG. 2.
Figure 6:
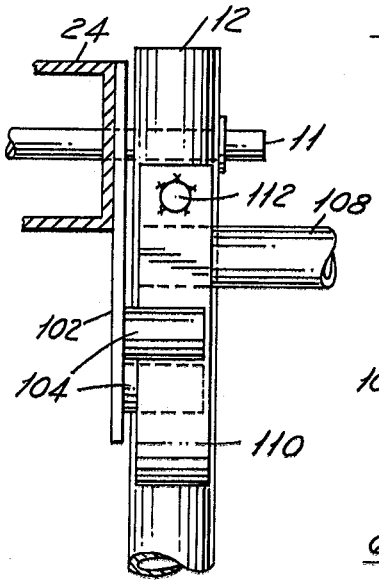
Figure 7:
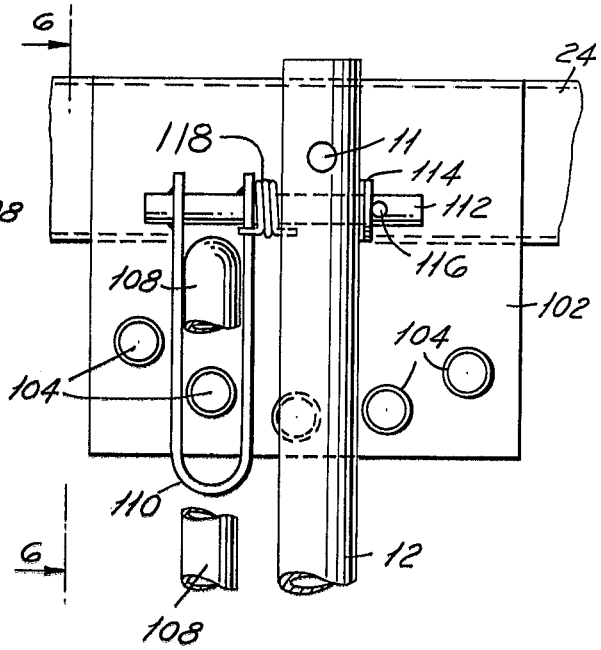

FIGS. 4 and 5 are respective side views of the water nozzle and the seeder nozzle illustrated in FIGS. 1-3; and FIGS. 6 and 7 are respective front and side views of means for adjusting the elevational angle of the apparatus illustrated in FIGS. 1-3, FIG. 6 being a sectional view taken along the line 6—6 in FIG. 7.

Referring in more detail to the drawings, an axial flow fan or blower head 10 is pivotally mounted by pins 11 to a yoke 12 which is supported on a tripod base 14 such that head 10 and yoke 12 may be rotated about an upright axis through an arc of three hundred sixty degrees with respect to the support base. One leg 16 of support base 14 extends rearwardly, as best seen in FIG. 1, and has an electronic control/junction box 18 mounted thereto. Box 18 includes suitable switches, etc., for operating blower head 10 in accordance with the discussion to follow. Yoke 12 and tripod base 14 may be provided in the form of a weldment assembly fabricated from suitable angle iron or pipe stock, and is preferably carried by suitable wheels equipped with low pressure, wide tread tires (not shown) to facilitate transportation of the snow machine. An anchor 20 (FIG. 1) may extend from one or more of the base support legs for holding the snow machine in fixed position during operation. Blower head 10 comprises an impeller fan 26 having a circumferential array of radial blades 28 drivably connected to an electric motor 22. Motor 22 is coaxially supported by a circumferential array of stationary vanes 30 fixed within a cylindrical housing or cowling 24 which is preferably of constant diameter throughout the axial length thereof. Vanes 30 are preferably arced when viewed in radial cross section such that a generally spiral air pattern generated by impeller 26 is converted by vanes 30 to a substantially linear unidirectional high-volume air stream at near atmospheric pressure. In one working embodiment of the invention, cowling 24, impeller 26, vanes 30 and motor 22 are packaged as integral units and sold by Aerovent Company of Piqua, Ohio under Model No. V301-Y42.

In accordance with the present invention, the rear or intake end of cowling 24 has an outwardly flared blower collar 32 secured thereto which is covered by a coarse mesh screen 34. The primary purpose of screen 34 is to prevent an operator from injuring his hands in impeller 26 during operation of the machine. Although a fine mesh screen would additionally prevent leaves and twigs, etc., from entering the air stream, it has been found that a fine mesh screen also tends to clog with ice and debris, and therefore reduces the overall machine efficiency. Preferably, blower head 10 is spaced by yoke 12 and support base 14 (FIG. 1) several feet above the ground, thus minimizing the opportunity for pick-up of leaves and twigs, or the like. An annular manifold 36 is mounted by a circular flange 37 (FIGS. 1 and 3) around the open output end of cowling 24 coaxially therewith, and has a fitting 38 extending therefrom for connection by a hose 40 to a water source (not shown).

In accordance with one feature of the invention, an arcuate array of water nozzles 42 extends axially outwardly from manifold 38 at a first radius from the blower centerline 43 (FIG. 2) to form a semi-circular row of evenly spaced pressure water spray outlets disposed primarily above the column of air exiting from cowling 24. As best seen in FIGS. 1, 3 and 4, each nozzle 42 comprises a coupling element 44 threadably received onto a corresponding male pipe 45 welded onto manifold 38. An elbow pipe 46 is connected to coupler 44 by a male pipe 48, and a "corkscrew" nozzle 50 is threadably received into the open end of elbow 46. An angle for elbow 46 of 16° with respect to the blower centerline 43 has been found to yield satisfactory results. In the above-mentioned working embodiment of the invention, nozzles 50 comprise 12 No. TF8NN fog nozzles manufactured by BETE Fog Nozzle, Inc. of Greenfield, Mass.

A pair of arcuate manifolds 52,54 is carried by supports 56 radially outwardly of manifold 38, each manifold 52,54 having a plurality of water spray nozzles 58 extending axially therefrom. As best seen in FIGS. 1–3, nozzles 58 are carried radially outwardly of nozzles 42 at a second radius from blower centerline 43. Nozzles 58 may be identical to nozzles 42 but for added operational flexibility preferably comprise, in the aforementioned working example, eight No. TF10NN fog nozzles manufactured by above-mentioned BETE Fog Nozzle, Inc. Each manifold 52,54 is connected by an associated hose 60,62 to a corresponding valve 64,66 on manifold 38 such that the nozzles on each outer manifold may be selectively activated by an operator according to climatic conditions.

In accordance with another feature of the present invention, an upwardly directed duck-bill seed nozzle 70 is mounted by a bracket 72 (FIGS. 1, 2, 3 and 5) to manifold 38 at the lower vertical center of the air stream. As best seen in FIG. 5, bracket 72 includes a slotted hole 74 received over a corresponding threaded stud 76 on the inside edge of manifold 38 for horizontal adjustment of nozzle 70 with respect to the cowling outlet. Shims or washers 78 may be inserted between bracket 72 and manifold 38 for alignment of the bracket with cowling 24 (FIG. 3). Nozzle 70 is affixed to bracket 72 such that the nozzle is directed toward the air stream at an outward angle of about 60° to the cowling centerline 43. Nozzle 70 is connected by a fitting 80 to a coupler 82 which has an axial inlet connected through a valve 84 (FIGS. 2 and 3) to a source of compressed air (not shown) and a radial inlet connected by a hose 86 (FIGS. 2 and 3) to a valve 88 on water manifold 38. Mixture of compressed air and water in coupler 82 and expansion of such mixture upon exit from nozzle 70 causes formation of seed crystals in the air stream.

In accordance with a further feature of the invention, an arcuate air deflector plate 90 (FIGS. 1, 2 and 3) is positioned within the lower half of cowling 24 over an arc of 180° and is directed upwardly and outwardly at a preferred angle of about 20° with respect to blower centerline 43. As best seen in FIG. 3, deflector 90 is widest immediately below blower centerline 43 and tapers narrowingly toward the outside ends. The inner edge 92 of deflector 90 abuts the inside surface of cowling 24, and is preferably welded thereto over the entire deflector arc, such that air cannot leak beneath the deflector. Deflector 90 "lifts" the lower portion of the air stream from impeller 26 and directs such lower stream portion upwardly in the general direction of nozzles 42,58. By effectively increasing the loft imparted to the lower portion of the air stream, deflector 90 increases the amount of time that water spray droplets or crystals remain in the air stream before falling to the ground. For purposes of illustration only, the air stream pattern, the water spray patterns from nozzles 42,58 and the seeding pattern from nozzle 70 have been illustrated in phantom in FIG. 1.

In accordance with one important aspect of the present invention, nozzles 42 are provided in only the upper 180° of manifold 38, i.e., at or above blower centerline 43. Preferably, twelve nozzles 42 are provided in an equally spaced array extending over arcs of 70° on either side of the vertical center of blower head 10, as best seen in FIG. 2. Four evenly spaced selectable nozzles 58 extend in arcs of between 24° and 50° on either side of the vertical. Disposition of nozzles 42,58 in only the upper half of the air stream rather than entirely around the air stream as in the above-referenced Kircher patent not only reduces the dribble effect, probably because the water is sprayed into the air stream from above and thus is less likely to fall out of the air stream before crystalization, but also increases both the quality and the quantity of deposited snow under given climatic conditions.

Deflector 90 has been found to cooperate with the placement of nozzles 42,58 above the blower center to substantially eliminate the dribble effect in the above-mentioned working embodiment of the invention. It is believed that this synergistic effect is a result of the fact that deflector 90 redirects the lower portion of the main air stream toward the water nozzles such that such air stream portion meets the water spray from nozzles 42,58 at a greater angle than would otherwise be the case. This increased angle of incidence not only helps disperse the water droplets throughout the air stream but also tends to prevent such water droplets from proceeding directly through the air stream toward the ground. Moreover, as noted above, deflector 90 increases the droplet travel time and distance prior to deposition to provide enhanced opportunity for crystalization. It will also be noted with reference to FIG. 1 that seeder nozzle 70 is disposed with respect to the main air stream in the "shadow" of deflector 90. The effect of deflector 90 upon the main air stream tends to create a low pressure zone at the output of seed nozzle 70. Thus, deflector 90 is believed to cooperate with nozzle 70 by pulling the seed water/air mixture toward and into the air stream at higher velocity to enhance seed crystal formation and dispersion.

To demonstrate the effectiveness of the present invention by way of example, in the above-referenced working embodiment of the invention wherein blower head 10 delivers a high-volume air stream of 16,000 cubic feet per minute, and with a water manifold pressure of 100 pounds per square inch, good quality snow was produced at a water consumption rate of about 100 gallons per minute with all nozzles operating at an ambient temperature of 20° F and a relative humidity of 70 percent. Good quality snow is defined as snow which provides: (1) maximum mass or density for given ambient conditions to an upper limit at which water "bleeds" out of the snow deposited, and (2) good handling characteristics in terms of adaptability to machine grooming. A different ambient condition of 28° F and 75 percent relative humidity, and with only nozzles 42 and 70 in operation, good quality snow was produced at a water consumption rate of 50 gallons per minute.

It has been found to be advantageous to "loft" the air stream containing the water spray droplets and seed crystals into the air at a high trajectory to obtain maximum travel time prior to deposition. To accommodate a wide variety of terrain conditions, apparatus 100 is provided at one side of blower head 10 to adjust the pivotal position of the blower head with respect to yoke 12 and to thereby yield the desired trajectory. Referring to FIGS. 1–2 and 6–7, adjustment apparatus 100 comprises a plate 102 fixedly attached to cowling 24 and having a series of five cylindrical bosses 104 disposed thereon in an arcuate array at a fixed radius with respect to the axis of pivot pin 11. Bosses 104 are equally separated from each other by a preferred angle of 20°. A U-shaped yoke or clamp 110 has a pivot pin 112 extending therefrom through a hole in yoke 12 and has a bight which extends downwardly from pin 112 to encompass a selected boss 104. An arcuate handle 108 is fixedly attached to clamp 110 below pin 112. One or more spacing washers 114 encompass the end of pin 112 remote from clamp 110 and are held thereon by a pin 116. A helical spring 118 encompasses pin 112 between clamp 110 and yoke 12 to bias the clamp and handle in the downward position in which clamp 110 captures a selected boss 104 as illustrated in the drawings. To change the angle of elevation, handle 108 and clamp 110 are lifted or pivoted about the axis of pin 112 away from plate 102 and blower head 10 is then pivoted on pins 11 until a boss 104 corresponding to the desired blower head elevation angle is positioned beneath the clamp. In the embodiment illustrated, bosses 104 are positioned to hold blower head 10 at angles of minus 20°, 0°, 20°, 40° and 60° with respect to support base 14 (FIG. 1).

The invention claimed is:

1. A method of making artificial snow comprising the steps of:

(1) generating in ambient air which is at or below a temperature of 32° F by means of a ducted fan or blower a substantially unidirectional high-volume air stream at substantially atmospheric pressure in a zone overlying an area of the ground on which the artificial snow is to be deposited, (2) directing a flow of water in spray form into said air stream solely from a zone disposed generally above said air stream in the vicinity of the maximum velocity of said air stream, (3) directing a flow of seed crystals into said air stream solely from a zone disposed generally below said air stream, and (4) orienting the flows of said water spray and seed crystals at respective acute angles relative to the direction of travel of said air stream such that said flows converge and intermix in said air stream downstream of the respective points of entry of said flows into said air stream.

2. The method set forth in claim 1 wherein said flow of water spray enters said air stream generally at an angle of 16° relative to the direction of travel of said air stream.

3. The method set forth in claim 1 wherein said flow of seed crystals enters said air stream generally at an angle of 60° relative to the direction of travel of said air stream.

4. A method of making artificial snow comprising the steps of:

(1) generating in ambient air which is at or below a temperature of 32° F a substantially unidirectional high-volume air stream at substantially atmospheric pressure in a zone overlying an area of the ground on which the artificial snow is to be deposited, (2) directing a flow of water in spray form into said air stream solely from a zone disposed generally above said air stream in the vicinity of the maximum velocity of said air stream, (3) directing a flow of seed crystals into said air stream solely from a zone disposed generally below said air stream, (4) orienting the flows of said water spray and seed crystals relative to the direction of travel of said air stream such that said flows converge and intermix in said air stream downstream of the respective points of entry of said flows into said air stream; and (5) imparting an upward deflection to a lower portion of said air stream ahead of seed flow entry.

5. The method set forth in claim 4 wherein said lower portion of said air stream is deflected upwardly at an angle of substantially 20°.

6. A method of making artificial snow comprising the steps of:

(1) generating in ambient air which is at or below a temperature of 32° F by means of a ducted fan or blower a substantially unidirectional high-volume linear flow air stream at substantially atmospheric pressure in a zone overlying an area of the ground on which the artificial snow is to be deposited, (2) directing a flow of water in spray form into said air stream solely from a zone disposed generally above said air stream in the vicinity of the maximum velocity of said air stream, and (3) imparting an upward deflection to a lower portion of said air stream upstream of water flow entry.

7. The method set forth in claim 6 comprising the further steps of:

(4) directing a flow of seed crystals into said air stream at least from a zone disposed generally below said air stream and downstream of said upward deflection, and (5) orienting the flows of said water spray and seed crystals relative to the direction of travel of said air stream such that said flows converge and intermix in said air stream downstream of the respective points of entry of said flows into said air stream.

8. A method of making artificial snow comprising the steps of:

(1) generating in ambient air which is at or below a temperature of 32° F a substantially unidirectional high-volume linear flow air stream at substantially atmospheric pressure in a zone overlying an area of the ground on which the artificial snow is to be deposited, (2) directing a flow of bulk water in spray form into said air stream solely from a spray zone disposed generally around about half the periphery of said air stream in the vicinity of the maximum velocity of said air stream, (3) directing a flow of seed crystals into said air stream from externally of said air stream and water spray and generally radially opposite said spray zone relative to the axis of said air stream, (4) orienting the flows of said water spray and seed crystals relative to the direction of travel of said air stream such that said flows converge and intermix in said air stream downstream of the respective points of entry of said flows into said air stream, and (5) imparting an upward deflection to a lower portion of said air stream axially upstream of the entry of said flows into said air stream.

9. A method of making artificial snow comprising the steps of:

(1) generating in ambient air which is at or below a temperature of 32° F by means of a ducted fan or blower a substantially unidirectional high-volume linear flow air stream at a substantially atmospheric pressure in a zone overlying an area of the ground on which the artificial snow is to be deposited, (2) directing a flow of bulk water in spray form into said air stream at least from a zone disposed generally above said air stream in the vicinity of the maximum velocity of said air stream as the same exits the outlet of the duct, (3) directing a flow of seed crystals into said air stream at least from a zone disposed generally below said air stream, (4) orienting the flows of said water spray and seed crystals relative to the direction of travel of said air stream such that said flows converge and intermix in said air stream downstream of the respective points of entry of said flows into said air stream; and (5) imparting an upward deflection to a lower portion of said air stream immediately ahead of the path of entry of said flow of seed crystals into said air stream.

10. A method for making artificial snow comprising the steps of:

(1) generating in ambient air which is at or below a temperature of 32° F by means of a ducted fan or blower a substantially unidirectional high-volume air stream at substantially atmospheric pressure and having linear flow as distinguished from helical turbulent flow so as to project said air stream in a zone overlying an area of the ground on which the artificial snow is to be deposited, (2) directing a flow of bulk water in spray form into said air stream at least from a spray zone disposed generally around about half the periphery of said air stream in the vicinity of the maximum velocity of said air stream as the same exits the outlet of the duct, (3) directing a flow of seed crystals into said air stream from a zone disposed generally remote from said water spray zone, (4) orienting the flows of said water spray and seed crystals relative to the direction of travel of said air stream such that said flows converge and intermix in said air stream downstream of the respective points of entry of said flows into said air stream, and (5) imparting a deflection to said air stream in the vicinity of the duct outlet so as to deflect a semi-peripheral portion of said air stream toward the central axis of said air stream, said deflection occurring in a zone generally radially opposite said water spary zone.

* * * * *

UNITED STATES PATENT AND TRADEMARK OFFICE

CERTIFICATE OF CORRECTION

PATENT NO. : 4,105,161

DATED : August 8, 1978

INVENTOR(S) : Everett F. Kircher and James L. Dilworth

It is certified that error appears in the above-identified patent and that said Letters Patent are hereby corrected as shown below:

IN THE ABSTRACT - Line 1, cancel "and machine"

Column 1, the title should read: -- METHOD OF MAKING ARTIFICIAL SNOW --

Column 1, line 34, "deposite" should read -- deposit --

Column 2, line 58, "38" should read -- 36 --

Column 2, line 65, "38" should read -- 36 --

Column 3, line 7, "38" should read -- 36 --

Column 3, line 18, "38" should read -- 36 --

Column 3, line 24, "38" should read --36 --

Column 3, line 27 "38" should read -- 36 --

Column 3, line 30, "38" should read -- 36 --

Column 3, line 39, "38" should read -- 36 --

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*